US008528350B2

(12) United States Patent
Lee et al.

(10) Patent No.: US 8,528,350 B2
(45) Date of Patent: Sep. 10, 2013

(54) ICE MAKING APPARATUS

(75) Inventors: Dong Hoon Lee, Incheon (KR); Wook Yong Lee, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 1043 days.

(21) Appl. No.: 11/873,175

(22) Filed: Oct. 16, 2007

(65) Prior Publication Data

US 2008/0256962 A1 Oct. 23, 2008

(30) Foreign Application Priority Data

Oct. 20, 2006 (KR) ..... 10-2006-0102087

(51) Int. Cl.
*F25C 1/00* (2006.01)

(52) U.S. Cl.
USPC ..... 62/137; 62/344

(58) Field of Classification Search
USPC ..... 62/137, 364
See application file for complete search history.

(56) References Cited

U.S. PATENT DOCUMENTS

| | | | | |
|---|---|---|---|---|
| 3,362,181 | A * | 1/1968 | Linstromberg | 62/135 |
| 6,857,279 | B2 * | 2/2005 | Kim et al. | 62/135 |
| 2005/0257536 | A1 * | 11/2005 | Chung et al. | 62/135 |
| 2007/0103323 | A1 * | 5/2007 | Yoshida et al. | 340/617 |
| 2007/0103940 | A1 * | 5/2007 | Chung | 363/16 |

FOREIGN PATENT DOCUMENTS

| | | |
|---|---|---|
| CN | 1153891 A | 7/1997 |
| CN | 1435623 A | 8/2003 |

OTHER PUBLICATIONS

Chinese Office Action dated Dec. 5, 2008.

* cited by examiner

*Primary Examiner* — Brandon M Rosati
*Assistant Examiner* — Lakiya Rogers
(74) *Attorney, Agent, or Firm* — KED & Associates LLP

(57) ABSTRACT

An ice making apparatus is provided. When an ice full detecting arm is not returned to an initial position by being caught on ice filled in the ice bank, it is determined that the ice bank is fully filled with the ice. Since the ice full detecting arm does not rotate when it is caught by the ice of the ice bank, the damage of the ice full detecting arm can be prevented.

18 Claims, 5 Drawing Sheets

ICE MAKING APPARATUS

CROSS-REFERENCE TO RELATED APPLICATIONS

This application claims the benefit of Korean Patent Application No. 10-2006-0102087, filed on Oct. 20, 2006, which is incorporated by reference in its entirety.

BACKGROUND

The present disclosure relates to an ice making apparatus.

An ice making apparatus is for making ice. The ice making apparatus discharges ice cubes made in an ice making tray into an ice bank by rotating an ejector. An ice full detecting unit includes an ice full detecting arm that is disposed in front of the ice making tray to rotate downward. When the ice full stops rotating downward by being caught on the ice cubes, a control unit determines that the ice bank is fully filled with the ice cubes. The ice full detecting arm rotates periodically to detect if the ice bank is fully filled with the ice cubes.

A user can take out the ice bank that is fully filled with the ice cubes and take the ice bank into the initial position. At this point, the control unit rotates the ice full detecting arm downward. In this case, since the current location of the ice full detecting arm cannot be determined, the ice full detecting arm cannot move to the initial position when the ice full detecting arm is caught on the ice cubes. Therefore, the ejector may stop actuating or the ice full detecting unit may be damaged.

Further, since the ice full detecting arm is disposed in front of the ice making tray, the ice full detecting arm may be damaged by being caught on the ice bank when the user takes in and out the ice bank.

In addition, since the ice full detecting arm is disposed in front of the ice making tray, a sufficient space in which the ice full detecting arm fully rotates is required in front of the ice making tray. Therefore, an installation space of the ice making apparatus may increase.

Further, the ice full detecting arm is disposed to be exposed to an external side. This detracts from the beauty of the view.

SUMMARY

Embodiments provide an ice making apparatus that is designed to prevent an ice full detecting unit from being damaged.

Embodiments provide an ice making apparatus that is designed to reduce a radius of rotation of an ice full detecting arm and thus reduce an installation space thereof.

In an embodiment, an ice making apparatus includes an ice making tray in which ice is made; an ejector for discharging the ice made in the ice making tray into an ice bank; a cam assembly cooperatively coupled to the ejector; an ice full detecting arm that is rotated by the cam assembly to detect if the ice bank is fully filled with the ice; a first ice full detecting member that detects if the ice bank is fully filled with the ice by detecting a position of the cam assembly when the cam assembly operates; and a second ice full detecting member that detects if the ice full detecting arm is not returned to an initial position by being caught on the ice.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. Although embodiments have been described with reference to a number of illustrative embodiments thereof, it should be understood that numerous other modifications and embodiments can be devised by those skilled in the art that will fall within the spirit and scope of the principles of this disclosure.

The following will describe an ice making apparatus according to an embodiment.

An ice making apparatus of the present invention may be applied to a variety of appliances such as a refrigerator, a water purifier, and the like. The following will describe a case where an ice making apparatus of the present invention is applied to the refrigerator by way of example.

Figure 1:
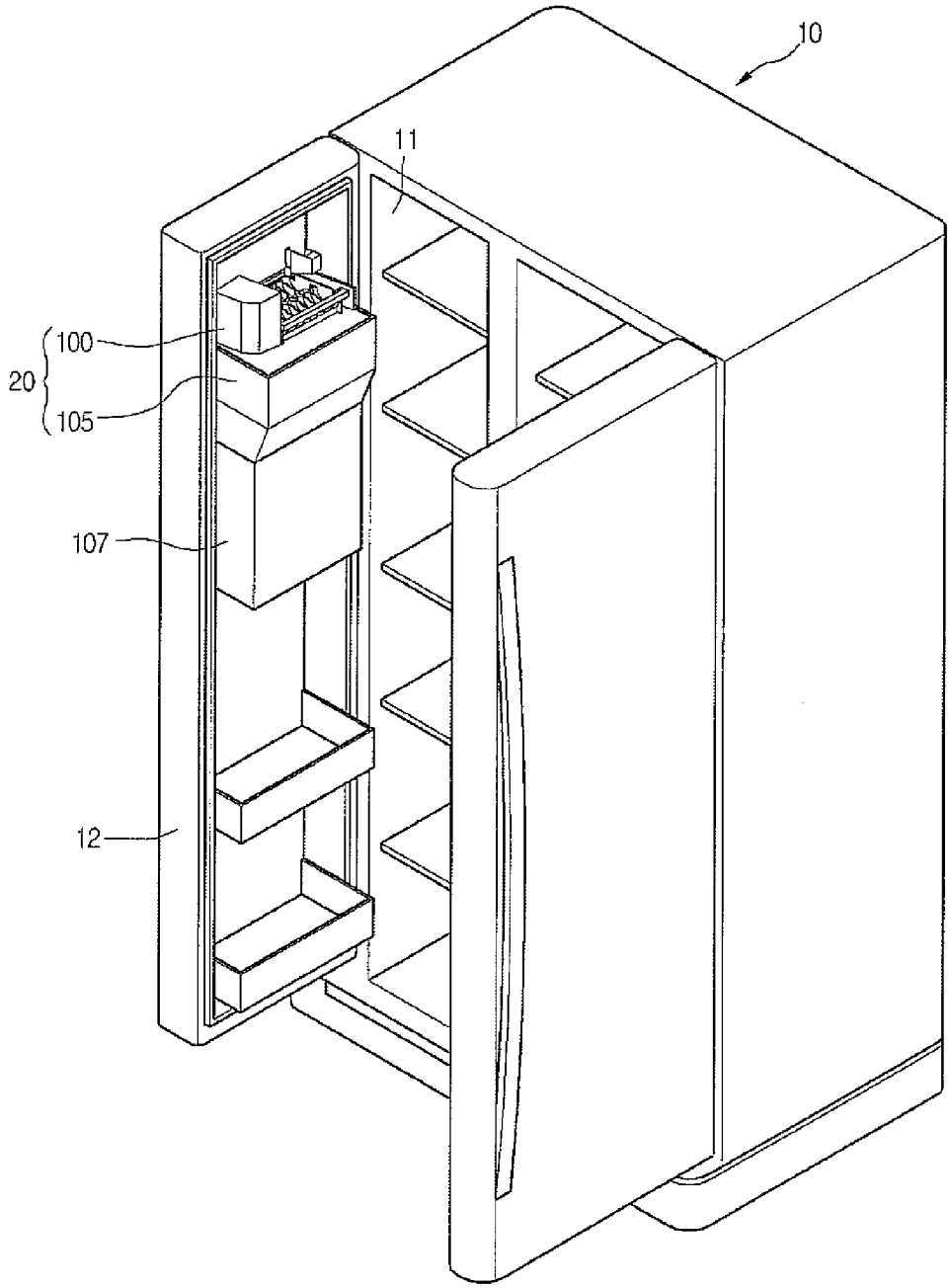
FIG. 1 is a perspective view of a refrigerator to which an ice making apparatus of an embodiment is applied.

FIG. 1 is a perspective view of a refrigerator to which an ice making apparatus of an embodiment is applied.

Referring to FIG. 1, a storage chamber 11 is defined in a refrigerator 10. The refrigerator 10 has doors 12 for opening and closing freezing and refrigerating compartments.

An ice making apparatus 20 may be installed in one of the doors 12 or the storage chamber 11. When the ice making apparatus 20 is installed in one of the door 12, a power source may be connected to the ice making apparatus 20 by an electric wire (not shown) passing through a hinge portion of the door 12. In FIG. 1, the ice making apparatus is installed in the door 12 of the refrigerator 10.

The ice making apparatus 20 includes an icemaker 100 for making ice and an ice bank 105 for storing the ice. The ice making apparatus 20 further includes a dispenser 107 for dispensing the ice out of the door 12. The ice making apparatus 20 may be comprised of only the icemaker 100 and the ice bank 105 or all of the icemaker 100, the ice bank 105, and the dispenser 107.

Figure 2:
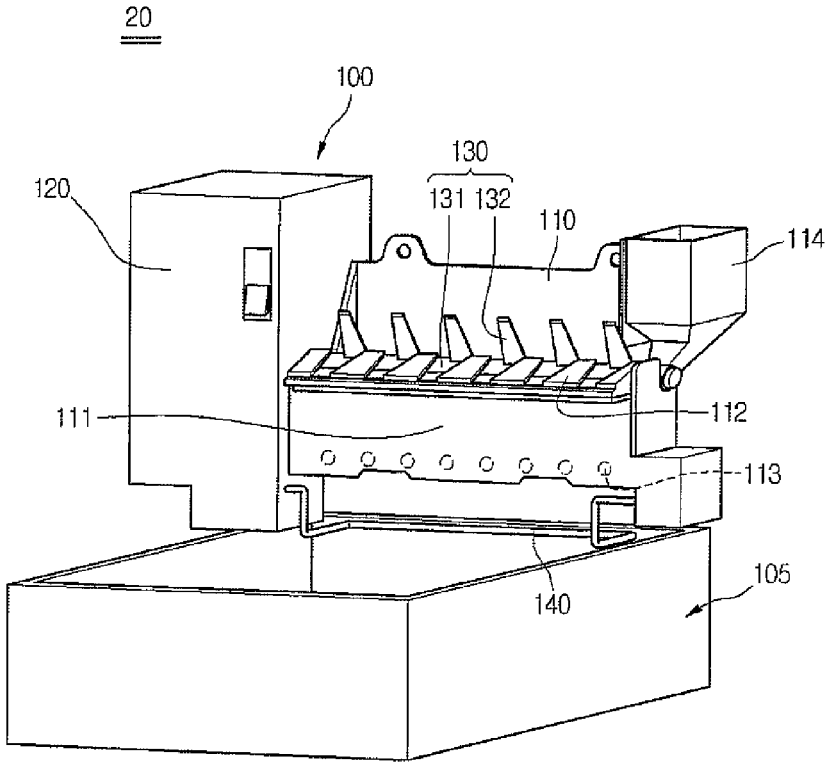
FIG. 2 is a perspective view of the ice making apparatus depicted in FIG. 1.
Figure 3:
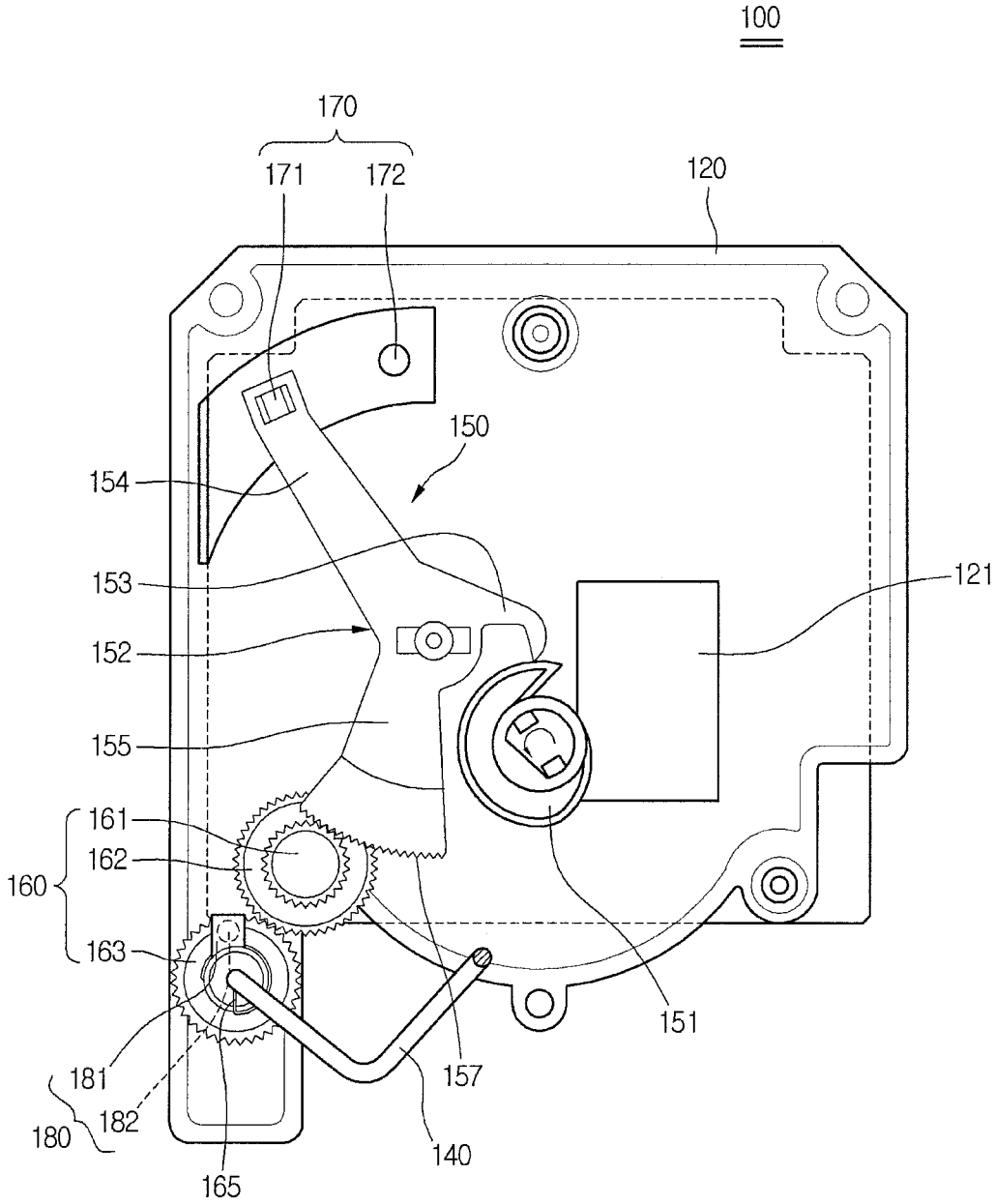
FIG. 3 is a schematic view of an ice full detecting arm of the ice making apparatus of FIG. 1.

FIG. 2 is a perspective view of the ice making apparatus depicted in FIG. 1 and FIG. 3 is a schematic view of an ice full detecting arm of the ice making apparatus of FIG. 1.

Referring to FIGS. 2 and 3, the ice bank 105 for storing the ice is disposed under the icemaker 100 for making the ice.

The icemaker 100 includes an ice making tray 110, a driving unit 120, an ejector 130, and an ice full detecting unit. The ice full detecting unit may include an ice full detecting arm 140, a cam assembly 150, and first and second ice full detecting members 170 and 180.

An ice making chamber 111 to which water is supplied is defined by the ice making tray 110 and ribs (not shown) are disposed in the ice making chamber 111 and spaced apart from each other. The ribs divide the ice making chambers 111 into different sections to make a plurality of ice cubes. In addition, slide bars 112 are disposed on a front side of the ice making tray 110 and spaced apart from each other by a predetermined distance. The slide bars 112 are inclined so that the ice cubes can smoothly slide. In addition, a heater 113 may be disposed on an under surface of the ice making tray 110 to easily discharge the ice cubes by slightly melting surfaces of the ice cubes.

A water supply portion 114 is disposed in the ice making tray 110. Since the water supply portion 114 functions to supply the water to the ice making chamber 111, the water supply portion 114 may be disposed above the ice making chamber 111. A water supply pipe (not shown) is connected to the water supply portion 114.

The driving unit 120 is disposed beside the ice making tray 110. The driving unit 120 includes a motor unit 121. The motor unit 121 may include a motor (not shown) and a gear box (not shown).

The ejector 130 is connected to the motor unit 121 to be capable of rotating. The ejector 130 includes a rotational shaft 131 disposed across the ice making chamber 111 and a plurality of ejector pins 132 arranged on the rotational shaft 131 at predetermined intervals. The rotational shaft 131 is rotatably inserted in a side of the ice making tray 110. Therefore, when the ejector 130 rotates, the ejector pins 132 rotate passing between the slide bars 112.

The ice full detecting unit is cooperatively coupled to the driving unit 120.

The cam assembly 150 and the first and second ice full detecting members 170 and 180 are disposed inside the driving unit 120 and the ice full detecting arm 140 is disposed outside the driving unit 120.

The cam assembly 150 includes a driving cam 151 coupled to the ejector 130 and rotating together with the ejector 130, a lever 152 rotating together with the driving cam 151, and a gear unit 160 rotating together with the lever 152.

A rotational shaft of the driving cam 151 is coupled to the rotational shaft 131 of the ejector 130. A radius of the driving cam 151 is gradually increased and terminated at a predetermined portion.

Further, the lever 152 is provided with a protruding portion 153 contacting an outer circumference of the driving cam 151. The lever 152 is further provided with first and second extending portions 154 and 155 extending to an opposite side to the driving cam 151. Gear teeth 157 are formed on an end of the second extending portion 155.

The gear unit 160 is provided to synchronize with the gear teeth 157 of the second extending portion 155. The gear unit 160 includes a first gear 161 engaged with the gear teeth 157, a second gear 162 coupled to the rotational shaft 131 to which the first gear 161 is also coupled, and a third gear 163 engaged with the second gear 162.

At this point, the ice full detecting arm 140 may be elastically coupled to the gear unit 160. For example, a first end portion of the ice full detecting arm 140 is coupled to the third gear 163 by a torsion spring 165 in a state where the first end portion is fitted in the rotation shaft of the third gear 163. Therefore, when the ice full detecting arm 140 is caught on the ice cubes, the ice full detecting arm 140 does not rotate even if the cam assembly 150 is driven. At this point, the torsion spring 165 is tensioned. As the ice full detecting arm 140 is elastically coupled, the ice full detecting arm 140 is not damaged even if it is caught on the ice cubes.

The ice full detecting arm 140 is rotatably disposed under the ice making tray 110. The ice full detecting arm 140 is bent in an opposite direction to a direction in which the ice cubes are discharged from the ice making tray 110. The ice full detecting arm 140 may be disposed such that it is not caught on an upper end of the ice bank 105 when the ice bank 105 is drawn in and out. In this case, the damage of the components such as the ice full detecting arm 140 and the gear unit 160 of the ice full detecting unit can be prevented when the ice bank 105 is drawn in and out.

The first, second, and third gears are associated with each other with proper gear ratios allowing the ice full detecting arm 140 to rotate within a predetermined angle range.

A first magnet 171 is disposed on the first extending portion 154 of the lever 152 and a first ice full detecting sensor 172 is disposed near the first extending portion 154. Therefore, when the ejector 130 rotates to discharge the ice cubes to the ice bank 105 and thus the first extending portion 154 rotates by a predetermined angle, the first ice full detecting sensor 172 detects the first magnet 171. A hole sensor may be used as the first ice full detecting sensor 172. That is, the first ice full detecting member 170 may includes a first magnet 171 and the first ice full detecting sensor 172.

A second magnet 181 is disposed on the ice full detecting arm 140 and a second ice full detecting sensor 182 is disposed on the third gear 163. Accordingly, when the ice full detecting arm 140 and the third gear 163 rotate together, the second ice full detecting sensor 182 can always detect the second magnet 181. In addition, when the ice full detecting arm 140 cannot rotate together with the third gear 163 as the ice full detecting arm 140 is caught on the ice cubes, the second ice full detecting sensor 182 cannot detect the second magnet 181. Therefore, the ice full state is determined whether the second ice full detecting sensor 182 detects the second magnet 181. The second ice full detecting unit 180 includes the second magnet 181 and the second ice full detecting sensor 182.

Alternatively, the second ice full detecting sensor 182 may be disposed near the third gear 163. At this point, it is determined that the ice bank is fully filled with the ice cubes only when the ice full detecting arm 140 is not returned to the initial position. A hole sensor may be used as the second ice full detecting sensor 182. The following will describe a case where the second ice full detecting sensor 182 is disposed on the third gear 163.

Further, the first and second ice full detecting members 170 and 180 are electrically connected to a control unit (not shown).

The following will describe operation of the ice making apparatus 20 according to the embodiment.

Figure 4:
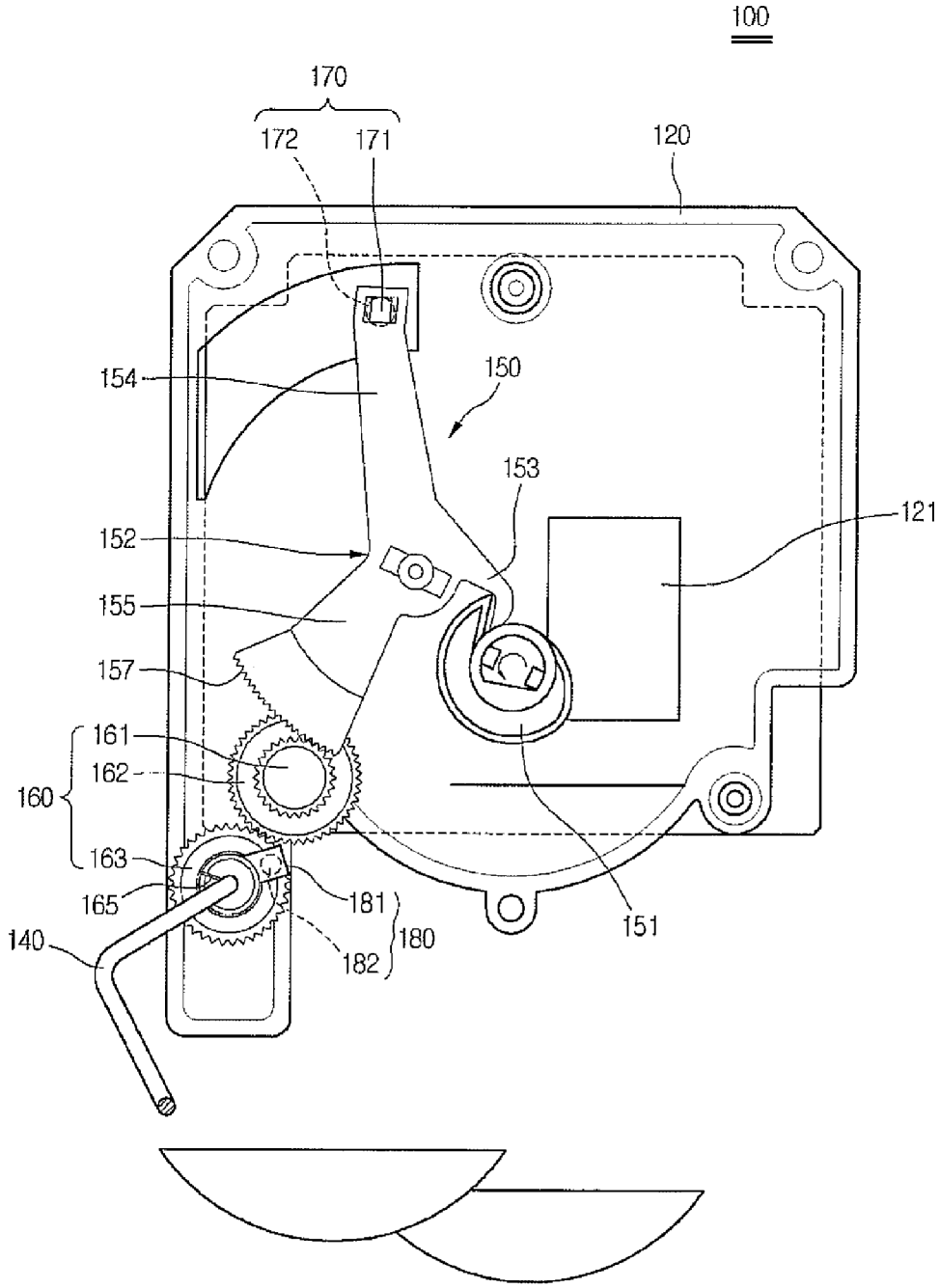
FIG. 4 is a schematic view illustrating a state where the ice full detecting arm detects that an ice bank is fully filled with ice cubes in the ice making apparatus of FIG. 2.
Figure 5:
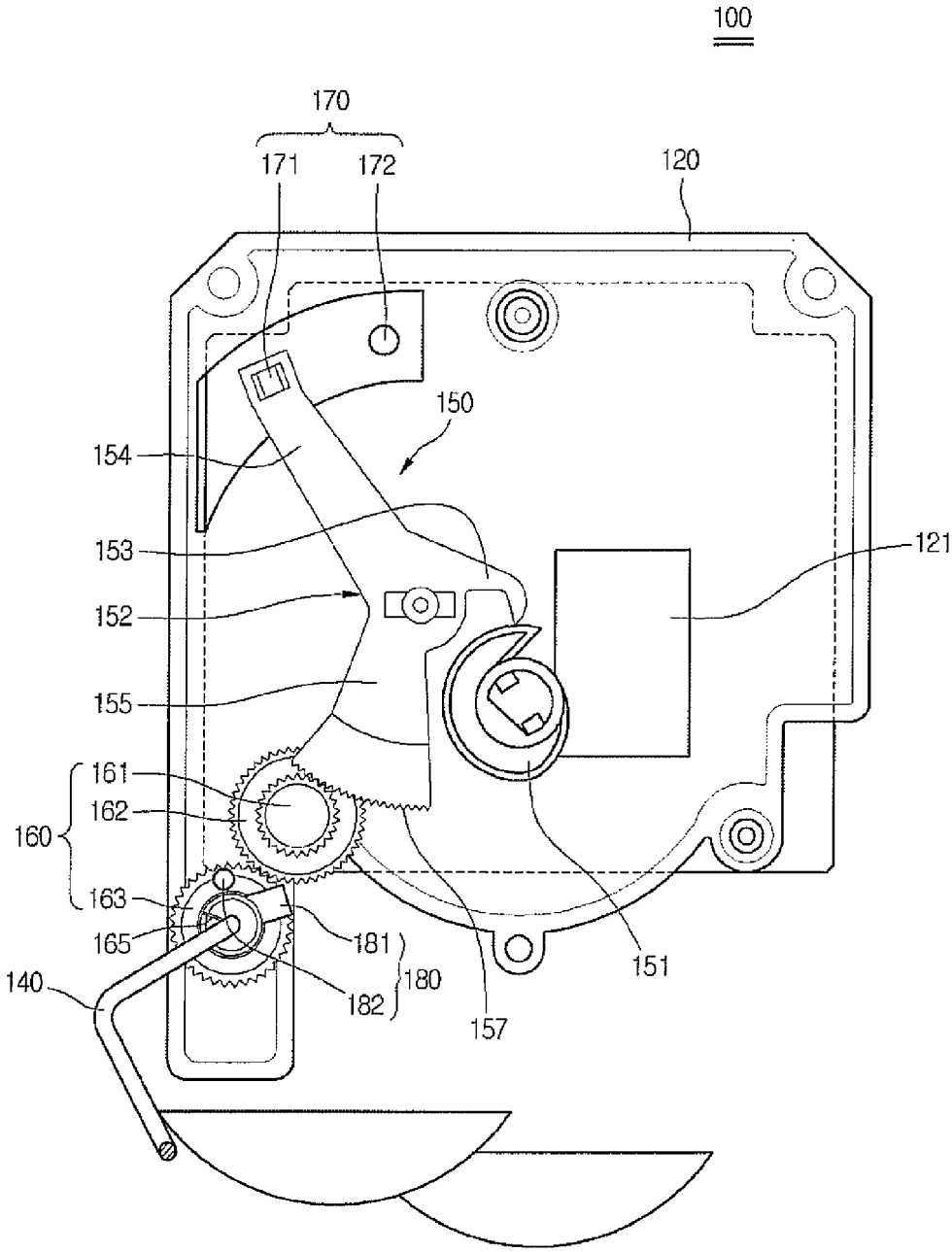
FIG. 5 is a schematic view illustrating a state where the ice full detecting arm is caught on the ice cubes filled in the ice bank in the ice making apparatus of FIG. 1.

FIG. 2 is a perspective view of the ice making apparatus depicted in FIG. 1, FIG. 3 is a schematic view of an ice full detecting arm of the ice making apparatus of FIG. 1, FIG. 4 is a schematic view illustrating a state where the ice full detecting arm detects that an ice bank is fully filled with ice cubes in the ice making apparatus of FIG. 2, and FIG. 5 is a schematic view illustrating a state where the ice full detecting arm is caught on the ice cubes filled in the ice bank in the ice making apparatus of FIG. 1.

Referring to FIGS. 2 and 3, the ice cubes are made by supplying water from the water supply portion 114 to the ice making chamber 111. When it is determined that the water is fully frozen, the control unit melts surfaces of the ice cubes using the heater 113.

Further, as the motor operates, the ejector 130 rotates. At this point, when the ejector pins 132 rotate, the ice cubes made in the ice making tray 110 move upward. When the ejector pins 132 further rotate, the ice cubes are discharged into the ice bank 105.

At this point, the driving cam 151 rotates together with the ejector 130. The driving cam 151 presses the contacting portion 153 of the lever 152 and thus the lever 152 rotates. Therefore, the first and second extending portions 154 and 155 rotate. The gear teeth 157 rotate the first, second, and third gears 161, 162, and 163. The ice full detecting arm 140 rotates together with the third gear 163 to detect if the ice bank is fully filled with the ice cubes.

The following will describe a case where the ice full detecting arm 140 is not caught on the ice cubes with reference to FIG. 4.

When the ice full detecting arm 140 is not caught on the ice cubes, the ice full detecting arm 140 is returned to its initial position. In this case, the first ice full detecting sensor 172 detects once the first magnet 171 of the first extending portion 154. Further, the third gear 163 rotates together with the ice full detecting arm 140 and thus the second ice full detecting sensor 182 detects always the second magnet 181 of the ice full detecting arm 140. In addition, the second ice full detecting sensor 182 rotates together with the ice full detecting arm and the second magnet 181 rotates together with the third gear 163. At this point, the second ice full detecting senor 182 faces the second magnet 181. Further, the torsion spring 165 maintains its initial state without being tensioned. Therefore, the control unit determines that the ice bank is not fully filled with the ice cubes and continues the ice making process.

The following will describe a case where the ice making detecting arm 140 is caught on the ice cubes with reference to FIG. 5.

Since the driving cam 151 rotates continuously when the ice full detecting arm 140 is caught on the ice cubes, the lever 152 and the first, second, and third gears 161, 162, and 163 rotate continuously. At this point, while the third gear 163 rotates, the ice full detecting arm 140 cannot rotate any more. Further, the second ice full detecting sensor 182 is in a stopped state together with the ice full detecting arm 140 and the second magnet 181 rotates together with the third gear 163. The second ice full detecting sensor 182 does not face the second magnet 181. At this point, the torsion spring 165 is tensioned.

Further, the first ice full detecting sensor 172 detects once the first magnet 171 of the first extending portion 154 while the second ice full detecting senor 182 cannot detect the second magnet 181 disposed on the ice full detecting arm 140. At this point, the control unit determines that the ice full detecting arm 140 is not returned to its initial position and stops the operation of the ejector 130. Therefore, the control unit determines that the ice bank is fully filled with the ice cubes and stops making the ice cubes. In addition, the control unit rotates periodically the ice full detecting arm to determine if the ice bank is fully filled with the ice cubes.

Meanwhile, the user can draw the ice bank 105 filled with the ice cubes and insert the ice bank 105 again to the initial poison. Then, the ice full detecting arm 140 rotates downward to detect if the ice bank 105 is fully filled with the ice cubes. At this point, when the ice full detecting arm 140 is caught on the ice cubes, the lever 152 is returned to the initial position but the ice full detecting arm 140 cannot be returned to the initial position. Therefore, the second ice full detecting sensor 182 cannot detect the second magnet 181. Therefore, the operation of the ejector 130 and the ice making process are stopped. As described above, it can be accurately determined by the first and second ice full detecting members 170 and 180 if the ice full detecting arm 140 is returned to the initial position.

According to the ice making apparatus of the embodiment, since the ice full detecting arm is disposed under the ice making case, there is no need to secure a space, which is sufficient to allow the ice full detecting arm fully rotates, in front of the ice full detecting arm. Therefore, the installation space for the ice making apparatus can be minimized.

In addition, since the ice full detecting arm is disposed not to be caught on the upper end of the ice bank when the ice bank is drawn out and in, the damage of the ice full detecting arm and the gear units by the ice bank can be prevented.

Furthermore, since the positions of the lever and the ice full detecting arm can be detected by the first and second ice full detecting members, it can be accurately determined if the ice full detecting arm is caught on the ice cubes. Therefore, the damage of the ice full detecting arm and the gear units can be prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice making apparatus, comprising:

an ice making tray in which ice is made;

an ejector that discharges the ice made in the ice making tray into an ice bank;

a cam assembly cooperatively coupled to the ejector, the cam assembly including a driving cam coupled to the ejector, a lever that rotates with the driving cam, and a gear assembly that rotates with the lever;

an ice full detecting arm that is rotated by the cam assembly to detect if the ice bank is fully filled with the ice, the ice full detecting arm being coupled to the gear assembly via a rotational shaft and concurrently rotatable with the gear assembly;

a first ice full detector that detects a position of the cam assembly when the cam assembly operates, the first ice full detector including a first magnet and a first sensor; and a second ice full detector, which is a separate detector from the first ice full detector, that detects if the ice full detecting arm is not returned to an initial position by being caught on the ice, the second ice full detector including a second magnet and a second sensor, wherein the second sensor is aligned with the second magnet detecting when the ice full detecting arm is returned to the initial position, while the second sensor misses the second magnet so as not to detect when the ice full detecting arm is caught on the ice.

2. The ice making apparatus according to claim 1, wherein the ice full detecting arm detects if the ice bank is fully filled with the ice by rotating by a predetermined angle in a direction in which the ice falls from the ice making tray.

3. The ice making apparatus according to claim 1, wherein the ice full detecting arm is elastically coupled to the cam assembly so as not to rotate when the ice full detecting arm is caught by the ice and the cam assembly operates.

4. The ice making apparatus according to claim 1, wherein the ice full detecting arm is disposed under the ice making tray and is bent in an opposite direction to a direction in which the ice falls from the ice making tray.

5. The ice making apparatus according to claim 1, wherein the first magnet is disposed on the lever, and the first sensor is disposed on a moving track of the lever to detect the first magnet when the lever moves.

6. The ice making apparatus according to claim 1, wherein the second magnet is disposed on the ice full detecting arm, and the second sensor is disposed on the gear assembly to detect the second magnet when the ice full detecting arm rotates.

7. A refrigerator comprising the ice making apparatus according to claim 1.

8. The ice making apparatus according to claim 1, wherein a rotating position of the lever is detected by the first magnet and the first sensor.

9. The ice making apparatus according to claim 8, wherein the ice full detecting arm is coupled to the gear assembly by a torsion spring.

10. The ice making apparatus according to claims 8, wherein the lever is provided with gear teeth and the gear assembly comprises:

a first gear engaged with the gear teeth of the lever;

a second gear coaxially disposed with the first gear; and a third gear engaged with the second gear and coupled elastically to the ice full detecting arm.

11. The ice making apparatus according to claim 10, wherein the ice full detecting arm is coupled to the third gear by a torsion spring.

12. The ice making apparatus according to claim 1, wherein the ice full detecting arm is elastically coupled to the cam assembly and bent rearward of the ice making tray so as not to be caught on the ice bank.

13. The ice making apparatus according to claim 1, wherein the ice full detecting arm is elastically coupled to the cam assembly by a torsion spring.

14. An ice making apparatus, comprising:

an ice making tray in which ice is made;

an ejector that discharges the ice made in the ice making tray into an ice bank;

a cam assembly cooperatively coupled to the ejector, the cam assembly including a driving cam coupled to the ejector, a lever rotated by the driving cam, and at least one gear that rotates with the lever;

an ice full detecting arm that is rotated by the cam assembly to detect if the ice bank is fully filled with the ice and elastically coupled to the cam assembly so as not to rotate when being caught on the ice filled in the ice bank;

a first ice full detector that detects a position of the cam assembly when the cam assembly operates; and a second ice detector, which is a separate detector from the first ice full detector, that detects if the ice full detecting arm is not returned to an initial position by being caught on the ice, the second ice full detector including a magnet disposed on the ice full detecting arm and a sensor disposed on the gear, wherein the sensor and the magnet face with each other when the ice full detecting arm is returned to the initial position, while the sensor misses the second magnet when the ice full detecting arm is caught on the ice.

15. The ice making apparatus according to claim 14, wherein the ice full detecting arm is coupled to the gear by a torsion spring.

16. The ice making apparatus according to claim 14, wherein the first ice full detector comprises:

a first magnet disposed on the lever; and a first ice full detecting sensor disposed on a moving track of the lever to detect the first magnet when the lever moves.

17. The ice making apparatus according to claim 14, wherein the ice full detecting arm is disposed under the ice making tray and bent rearward of the ice making tray.

18. A refrigerator comprising the ice making apparatus according to claim 14.

* * * * *